US005279076A

United States Patent [19]

Healy et al.

[11] Patent Number: 5,279,076

[45] Date of Patent: Jan. 18, 1994

[54] TIRE DUST REMOVAL APPARATUS

[75] Inventors: Stephen M. Healy, Islington; Daniel W. Diverty, Burlington, both of Canada

[73] Assignee: Belmar Equipment Inc., Brantford, Canada

[21] Appl. No.: 914,350

[22] Filed: Jul. 17, 1992

[51] Int. Cl.[5] ..... B24B 55/06

[52] U.S. Cl. ..... 51/273; 51/DIG. 33; 157/13

[58] Field of Search ..... 51/273, DIG.33; 157/13; 409/137

[56] References Cited

U.S. PATENT DOCUMENTS

| | | | |
|---|---|---|---|
| 2,535,281 | 12/1950 | Glynn | 51/273 |
| 2,788,851 | 4/1957 | Rawls et al. | 157/13 |
| 2,864,445 | 12/1958 | Hawkinson | 157/13 |
| 2,965,162 | 12/1960 | Hawkinson | 157/13 |
| 2,966,011 | 12/1960 | Peacock | 157/13 |
| 3,866,360 | 2/1975 | Monajjem | 51/DIG. 33 |
| 3,971,294 | 7/1976 | Devrick et al. | 409/137 |
| 4,438,977 | 3/1984 | Chapel | 51/273 |
| 5,047,089 | 9/1991 | Grant | 51/273 |

FOREIGN PATENT DOCUMENTS

| | | | |
|---|---|---|---|
| 0134429 | 10/1929 | Switzerland | 51/273 |

*Primary Examiner*—Roscoe V. Parker
*Attorney, Agent, or Firm*—R. Craig Armstrong

[57] ABSTRACT

Dust collection apparatus for collecting dust during the grinding of tires includes a collection head mounted on the end of an arm, the collection head having a series of brushes which are arranged to contact the surface of the tire in proximity to where the grinding is taking place, in order to remove and trap the dust. Vacuum aspiration removes the trapped dust from the area surrounded by the brushes, and conveys it away for disposal, preferably via the arm, the arm being hollow for that purpose. The brushes are arranged such that all or substantially all of the tire surface which has been ground is subjected to the brushes. The dust collection apparatus is preferably attached to the arm which carries the grinding wheel used in the grinding machine, such that when the grinding wheel is moved into position against the tire, the dust collection apparatus moves with it, and is positioned against the tire. In some embodiments, the collection head pivots, so that it can stay properly positioned against the tire, regardless of the tire diameter. Four primary embodiments, all substantially identical in principle, each one for a separate application, namely: (1) full face grinding; (2) shoulder grinding; (3) on-center grinding; and (4) sidewall grinding 4 Claims, 13 Drawing Sheets FIG.16.
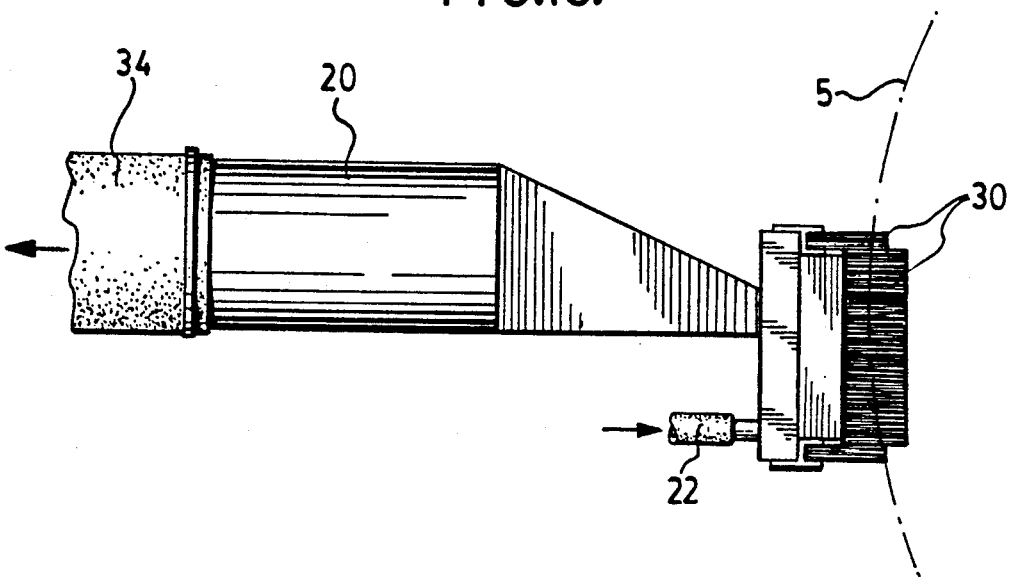
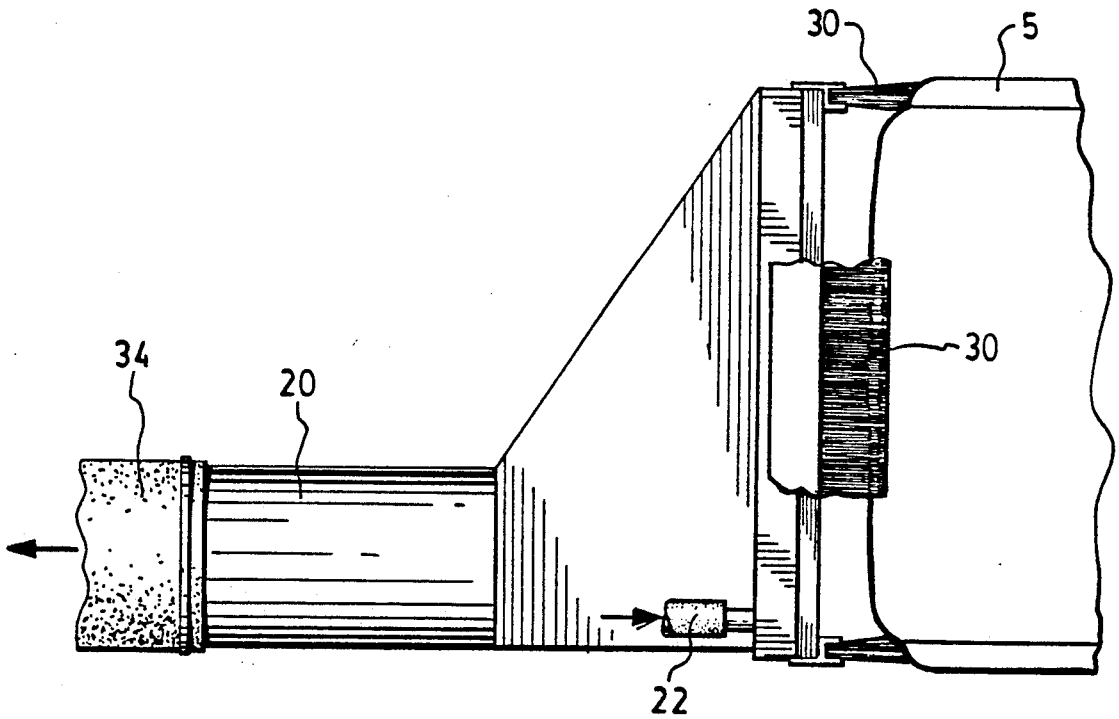
FIG.17.

FIG.19.
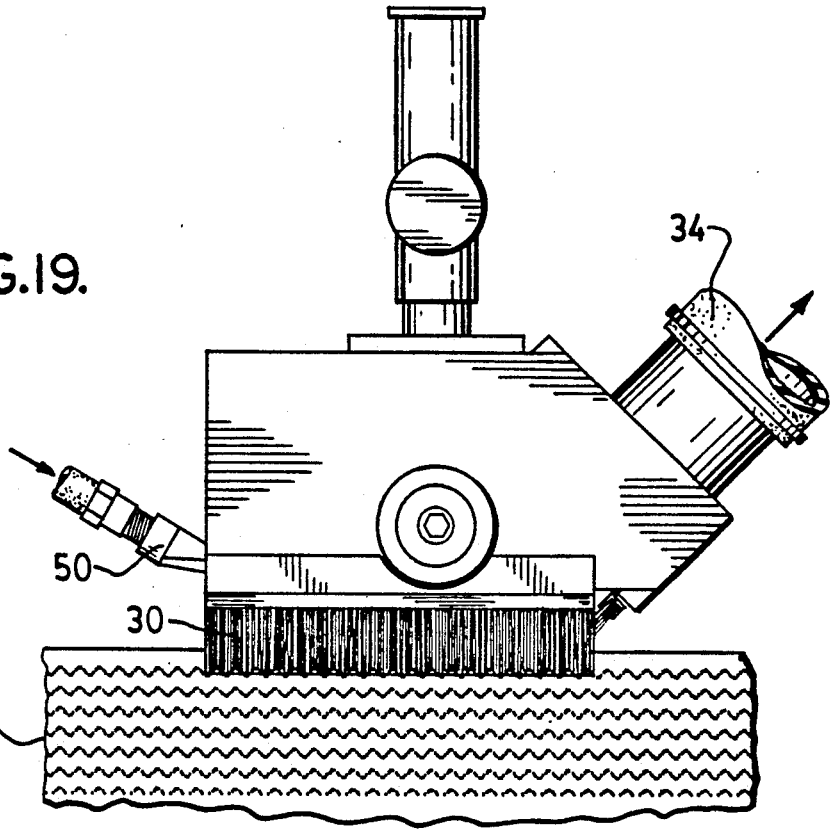
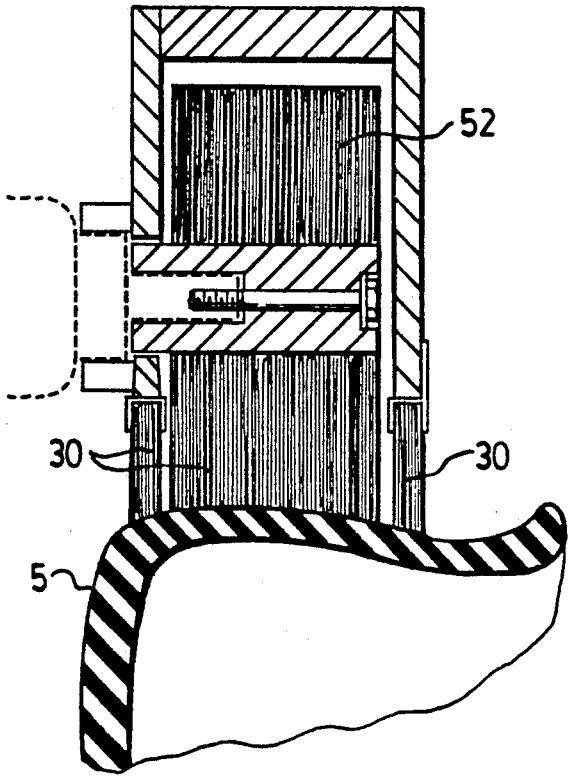
FIG.20.

TIRE DUST REMOVAL APPARATUS

BACKGROUND OF THE INVENTION

This invention relates to dust collection apparatus for use in the production of vehicle tires.

As part of the tire manufacturing process, one of the final steps is to balance the tire by grinding rubber away from appropriate portions of the tire tread or shoulder, so that proper dynamic balancing of the tire is achieved. This is commonly carried out by machines such as the P-855 model D70 tire uniformity machine manufactured by Akron Standard.

Similarly, the side walls of tires are often ground, as part of the process of producing white-wall tires.

In both of these grinding procedures, a large amount of dust is produced, a substantial portion of which clings to the tire and is eventually shipped with the tire, resulting in an end product which is somewhat dirtier and less aesthetically appealing than is desirable. In handling the tires, a certain amount of this dust inevitably comes off, requiring cleaning to varying degrees at every step, right up to and including the floor of new car dealerships.

There is therefore an obvious need to remove this dust during the grinding process, and indeed tire manufacturers have adopted various ad hoc measures to remove the dust from the regions of the grinding machine However, to date there has been no satisfactory method of collecting the dust as it is produced, and in particular there has been no satisfactory method of actually removing the dust from the surface of the tire (as opposed to collecting airborne dust in the region of the grinder).

SUMMARY OF THE INVENTION

It is an object of the invention to provide apparatus which will effectively remove most or all of the dust from the surface of the tire during the grinding process.

In the invention, the dust collection apparatus includes a series of brushes which are arranged to contact the surface of the tire in proximity to where the grinding is taking place, in order to remove and trap the dust. Vacuum aspiration means removes the trapped dust from the area surrounded by the brushes, and conveys it away for disposal. The brushes are arranged such that all or substantially all of the tire surface which has been ground is subjected to the brushes. The dust collection assembly is preferably attached to the arm which carries the grinding wheel used in the grinding machine, such that when the grinding wheel is moved into position against the tire, the dust collection apparatus moves with it, and is positioned against the tire.

In some embodiments, the collection head pivots, so that it can stay properly positioned against the tire, regardless of the tire diameter. In other embodiments, this is not necessary.

There are four primary embodiments, all substantially identical in principle, each one for a separate application, namely: (1) full face grinding; (2) shoulder grinding; (3) on-center grinding; and (4) sidewall grinding.

Further features of the invention will be described or will become apparent during the course of the following detailed description.

BRIEF DESCRIPTION OF THE DRAWINGS

The invention will now be described in greater detail with reference to the accompanying drawings, in which:

FIG. 16 is a plan view of the center grind embodiment, showing it in contact with a tire;

FIG. 17 is an elevation view of the center grind embodiment, showing it in contact with a tire;

FIG. 19 is an elevation view of the sidewall embodiment; and

FIG. 20 is another elevation view of the sidewall embodiment, in section and at 90 degrees to FIG. 19.

DETAILED DESCRIPTION OF THE PREFERRED EMBODIMENTS

As mentioned above, there are four primary embodiments, each one for a separate application, namely: (1) full face grinding; (2) shoulder grinding; (3) on-center grinding; and (4) sidewall grinding. These four embodiments will now be described in turn.

Full Face Grinding

FIGS. 1–7 show the apparatus used in conjunction with full face grinding, i.e. where the grinding takes place across the tread of the tire.

Figure 1:
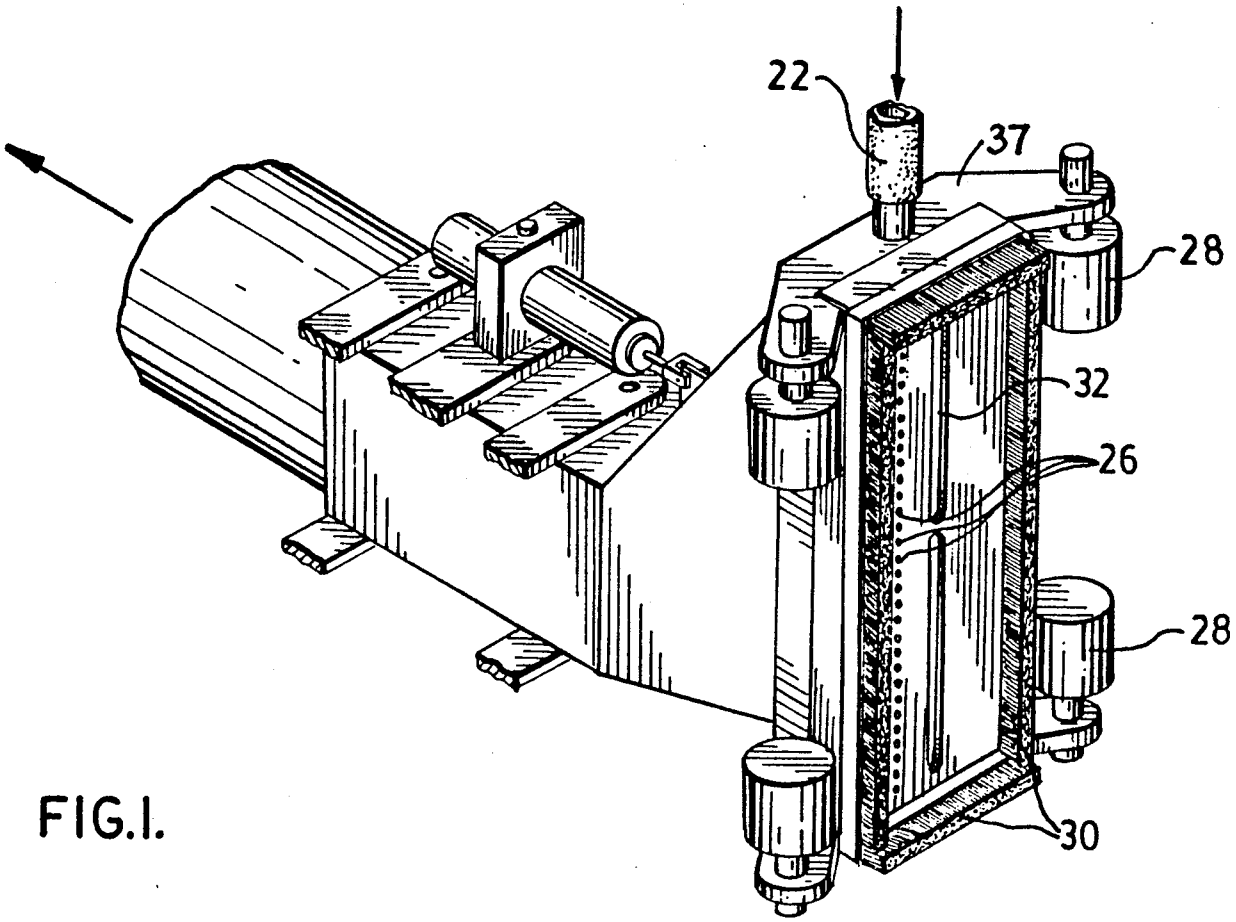
FIG. 1 is a perspective view of the "full face" embodiment of the invention, for collecting dust from the face or tread area of the tire.
Figure 2:
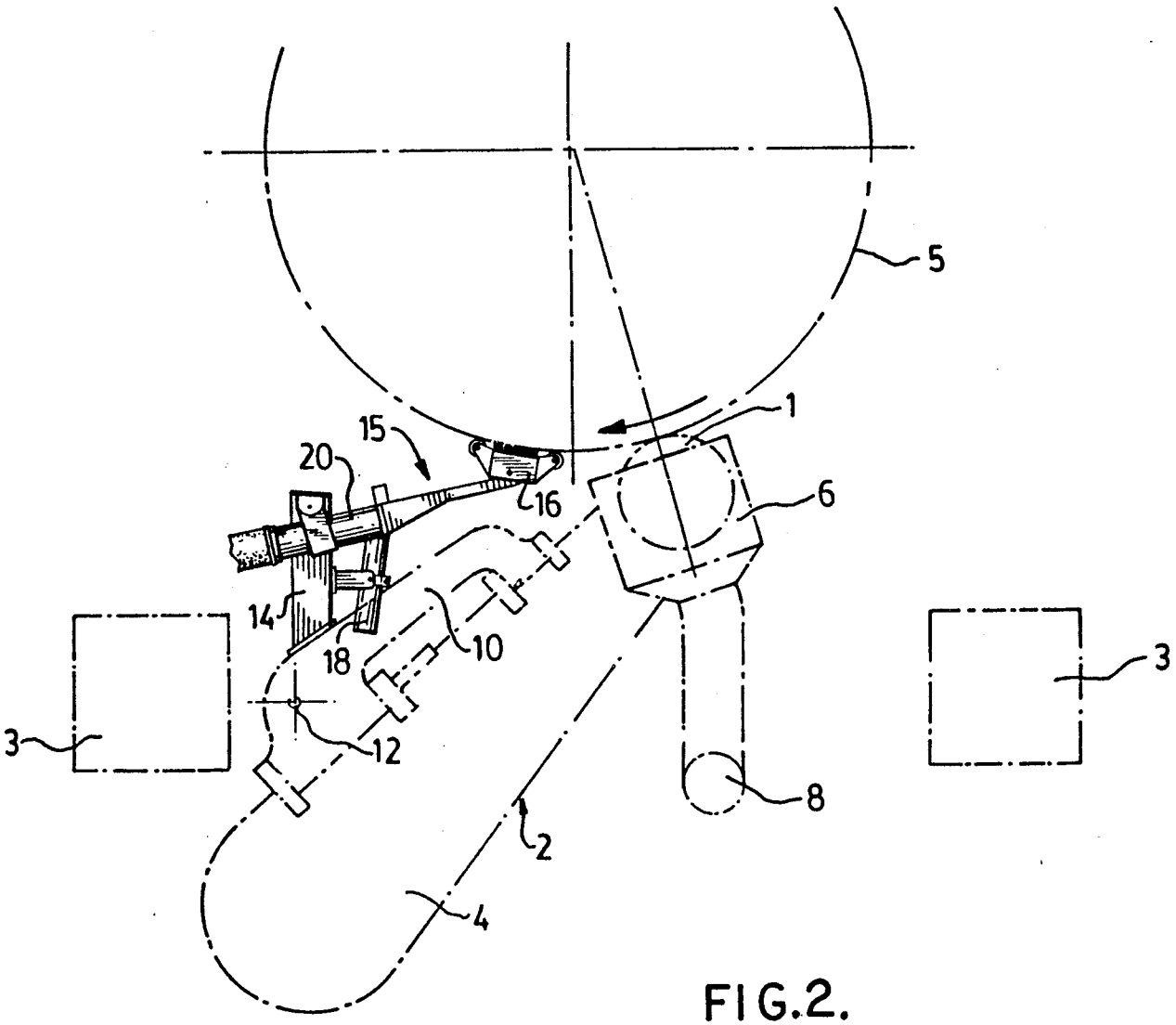
FIG. 2 is a plan view, showing the full face embodiment as mounted on the grinding machine.
Figure 3:
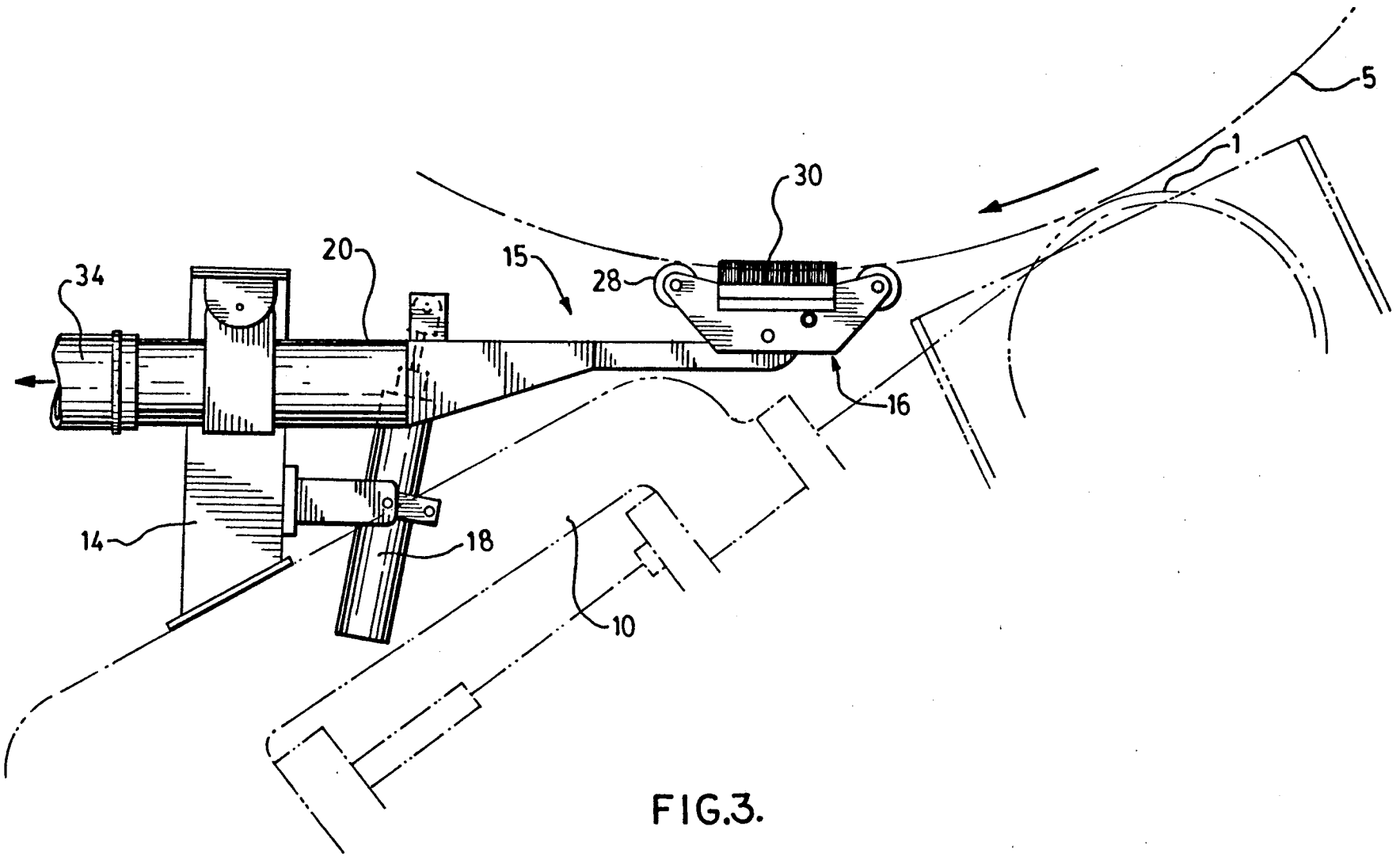
FIG. 3 is a similar plan view, showing more detail.
Figure 4:
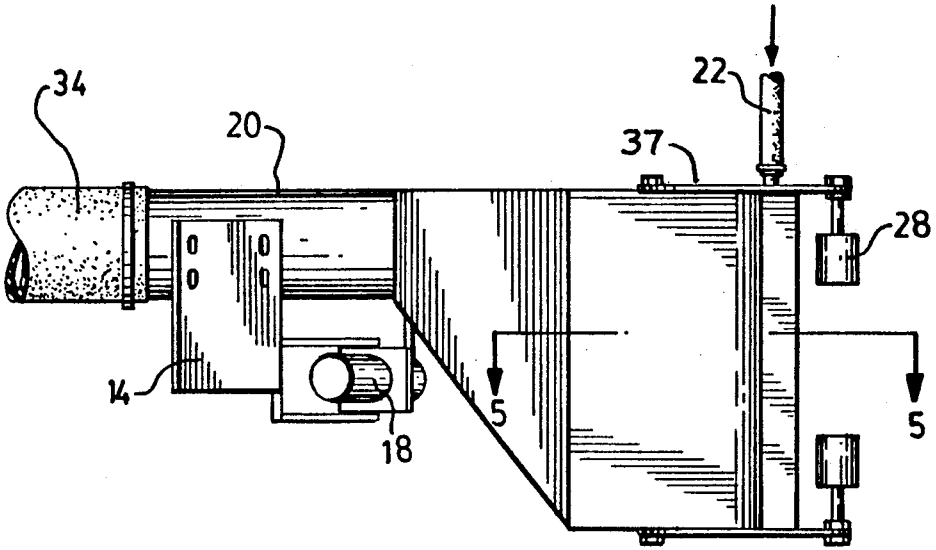
FIG. 4 is an elevation view of the outside of the full face embodiment.
Figure 5:
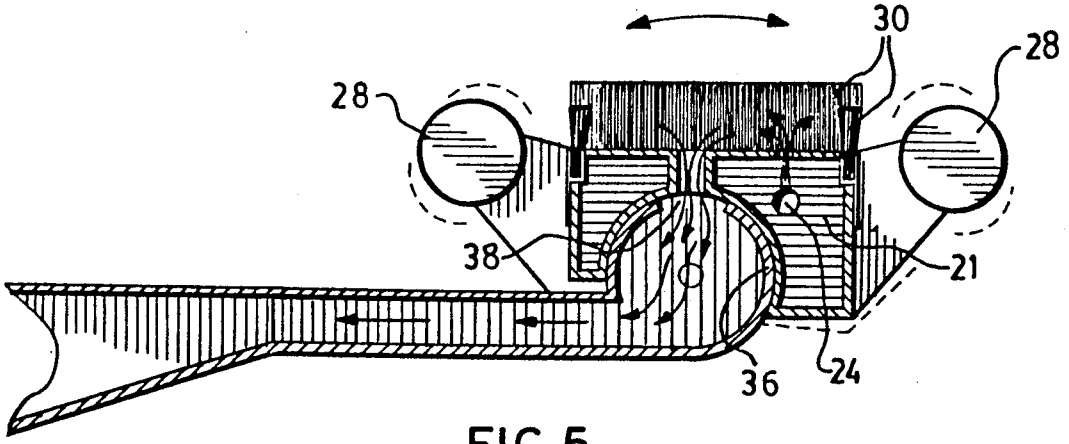
FIG. 5 is a plan view of the full face embodiment, in section.
Figure 6:
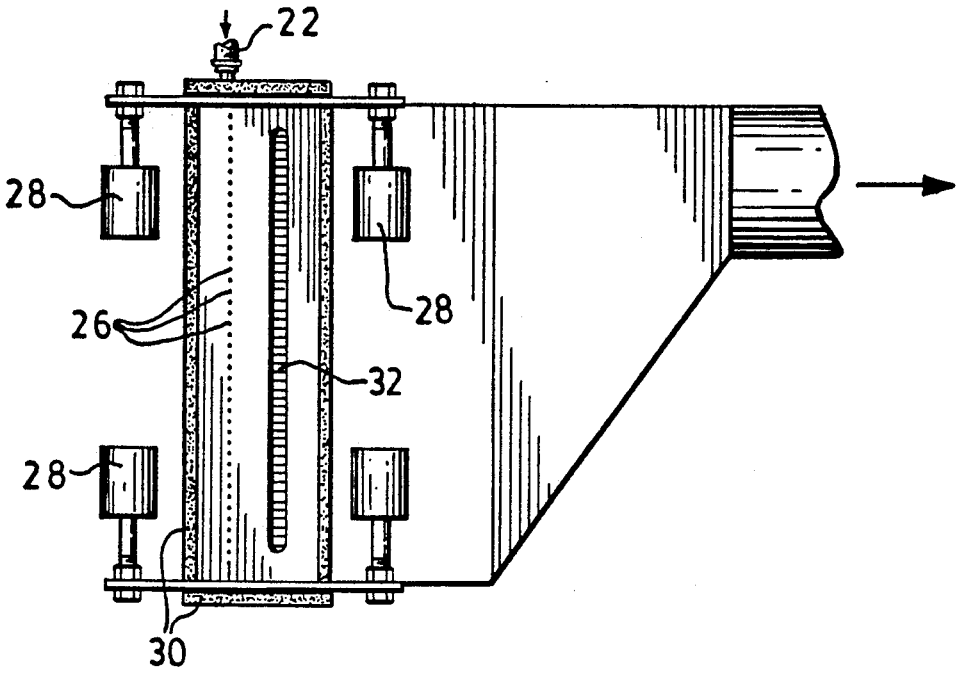
FIG. 6 is an elevation view of the side of the full face embodiment which faces the tire;.

The tire grinding apparatus, seen in FIG. 2, includes a grinding wheel 1 mounted on the end of a grinding arm 2 positioned between two main support posts 3. The grinding arm includes a drive belt (not shown) covered by a guard 4 which drives the grinding wheel from a motor (also not shown). A tire 5 is mounted horizontally for rotation as shown. The grinding wheel grinds rubber from the tire as it rotates past the grinding location, either from the shoulders of the tire or from the face or tread (depending on the machine). The embodiment of FIGS. 1-7 is for use in machines where the grinding is from the face of the tire.

A shroud 6 around the area of the grinding wheel collects some of the dust generated by grinding the tire and routes it away via a ventilation duct 8.

The grinding arm 2 is mounted on a support arm 10, which is pivotally mounted about a pivot point 12. The arm is pivoted to move the grinding wheel into and out of engagement with the tire, under computer control.

In the invention, it was recognized that arrangements such as shroud 6 did not function adequately in terms of dust collection. The shroud collects a certain amount of airborne dust and particulate matter, but fails to remove the substantial amount of dust which remains on the surface of the tire.

In the invention, a mounting bracket a 14 mounted on the support arm 10, and the dust collection assembly 15 is pivotally mounted to the bracket, for pivoting about a vertical axis such that the collection head 16 can be moved into and out of engagement with the tire, by operation of an actuator 18.

The dust collection assembly includes an arm 20 which is pivotally mounted to the mounting bracket 14 as aforesaid. Pivotally mounted at the end of the arm 20 is the collection head 16.

The collection head includes a plenum 21 which receives compressed air via an air hose 22 and inlet 24. The compressed air escapes from the plenum via air jet holes 26 directed towards the face of the tire, to blow the dust off the tire. The air jet holes are not right against the face of the tire, but are kept away from the tire by wheels 28 which ride against the tire. A dust collection volume is defined between the collection head and the face of the tire by four brushes 30.

The dust which is blown off the face of the tire is collected by a vacuum slot or slots 32 connected to a suction source (not shown) Although a separate hose could be used, it is preferable to use the arm 20 itself as a collection duct, the open end of the arm remote from the collection head then being connected to a collection hose 34.

To permit rocking of the collection head to accommodate different tire diameters, the arm 20 widens out into a cylindrical section 36. The collection head has a corresponding cylindrical socket which is slid onto the cylindrical section, and then held in place by end caps 37, which also support the wheels 28. A large slot 38 passes through the plenum 21 to communicates with the slot or slots 32.

Figure 7:
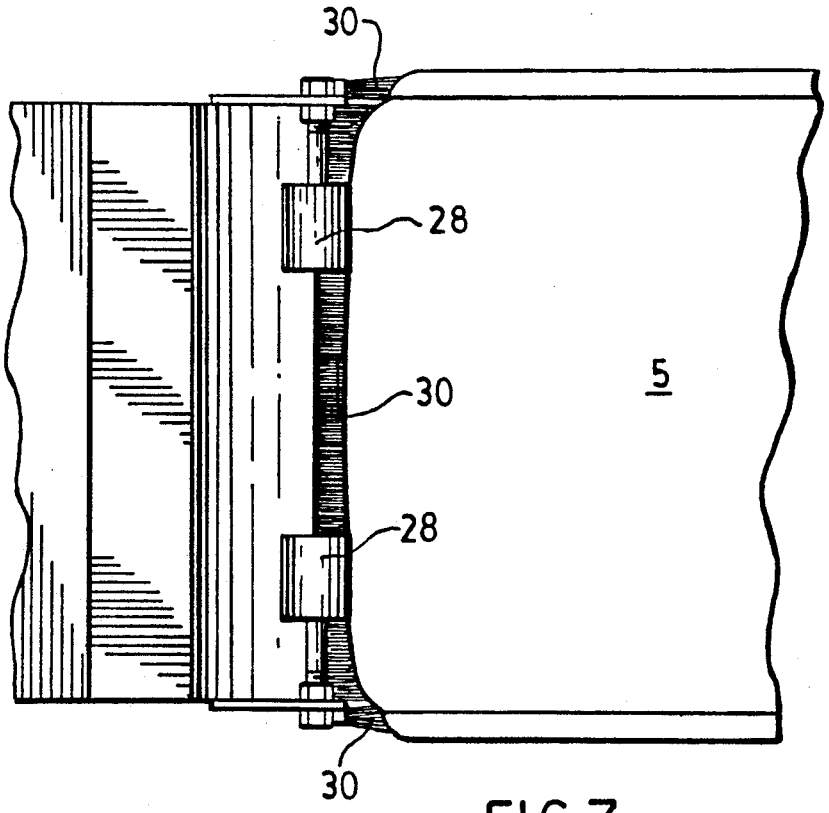
FIG. 7 is an elevation view showing the full face embodiment in contact with a tire.
Figure 8:
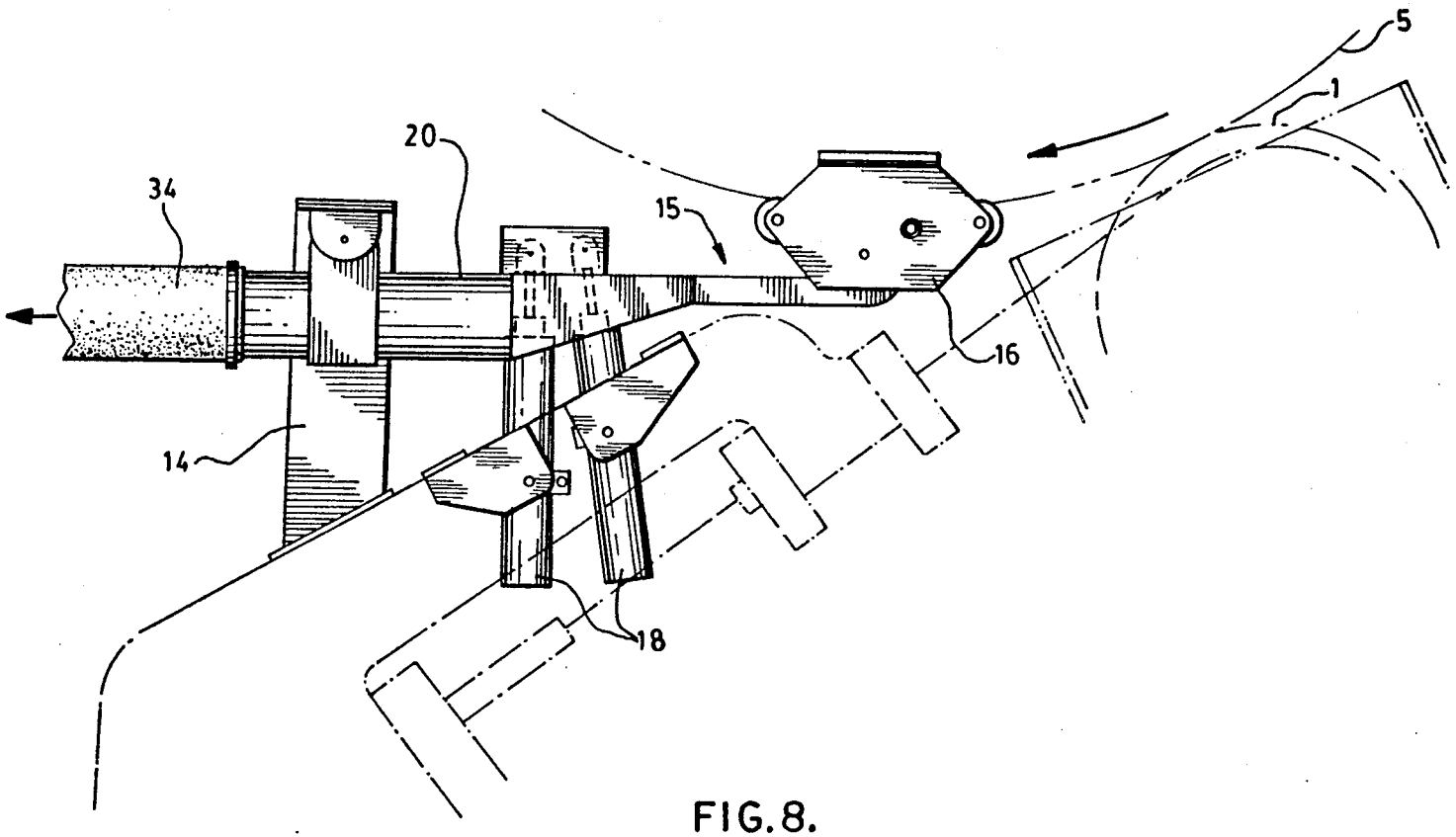
FIG. 8 is a plan view showing the "shoulder" embodiment of the invention.
Figure 9:
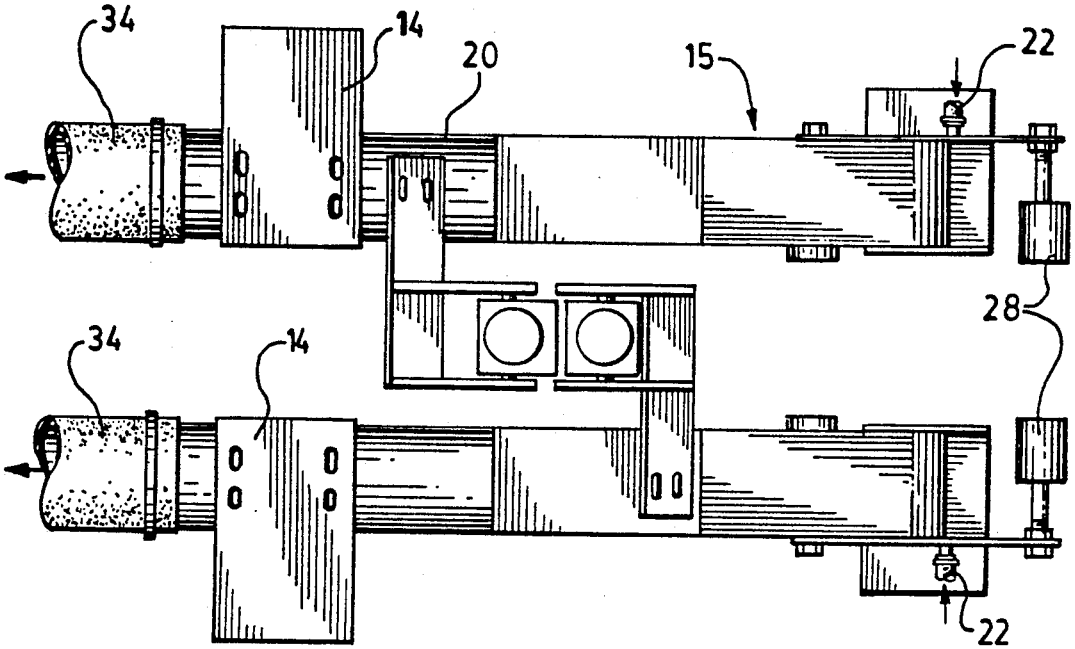
FIG. 9 is an elevation view showing the shoulder embodiment.
Figure 10:
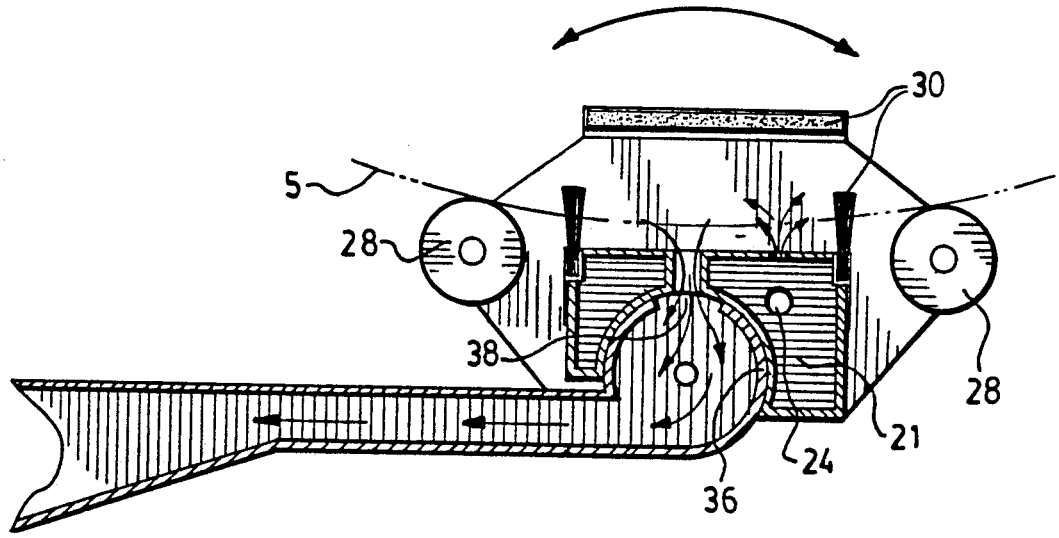
FIG. 10 is a plan view of the shoulder embodiment, in section.
Figure 11:
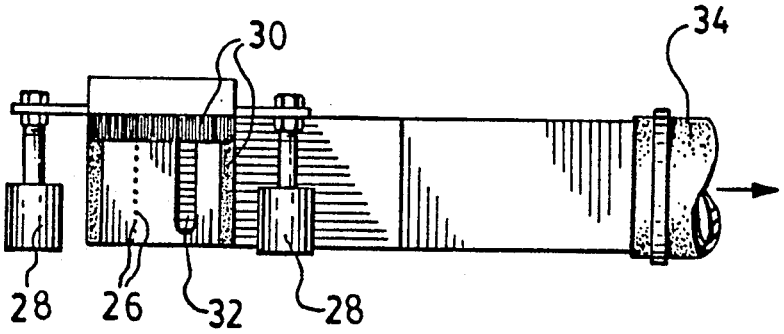
FIG. 11 is an elevation view of the side of the shoulder embodiment which faces the tire.
Figure 12:
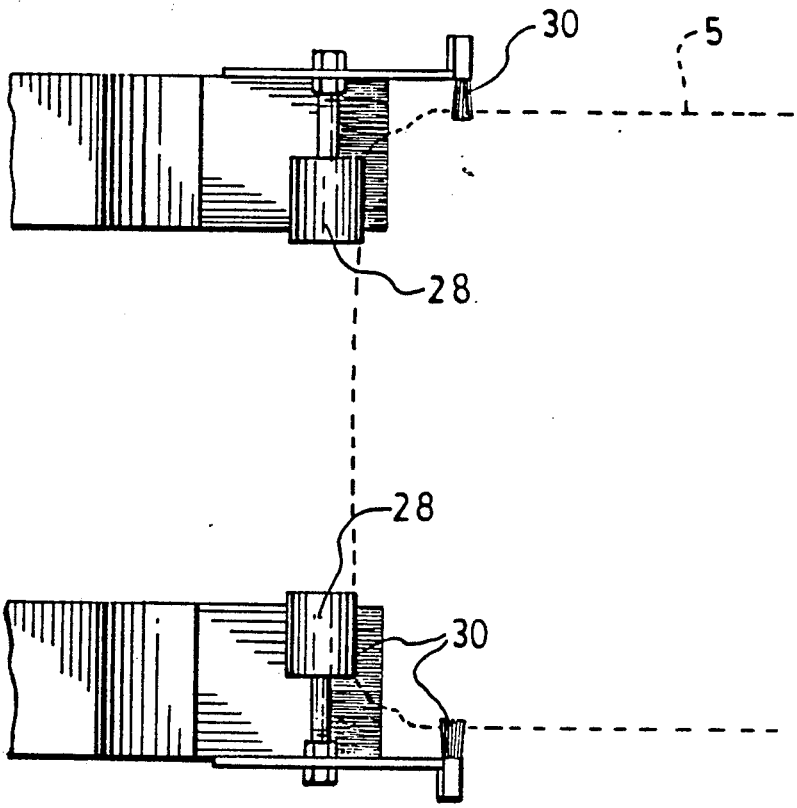
FIG. 12 is an elevation view showing the shoulder embodiment in contact with a tire.
Figure 13:
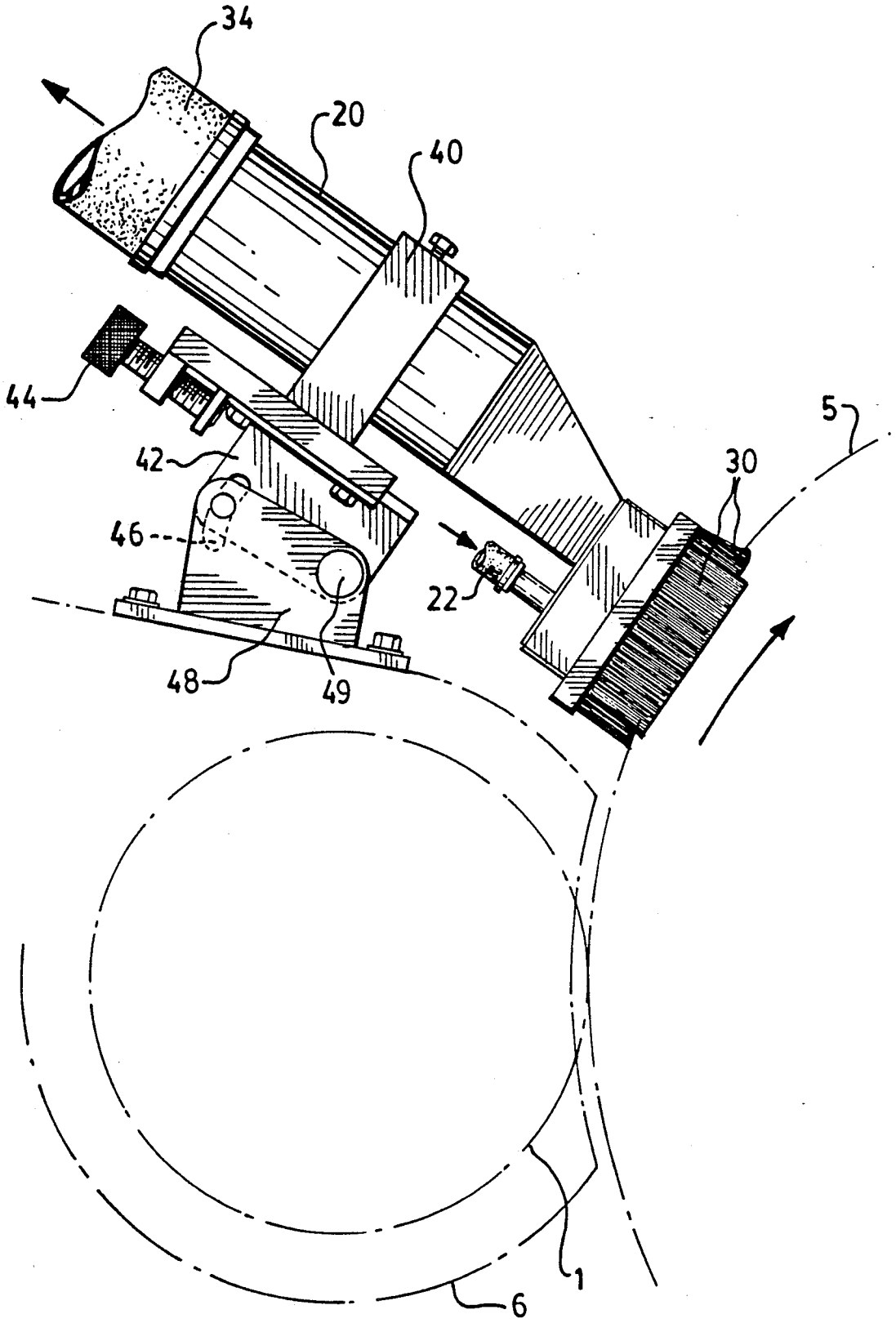
FIG. 13 is a plan view showing the "center grind" embodiment of the invention.
Figure 14:
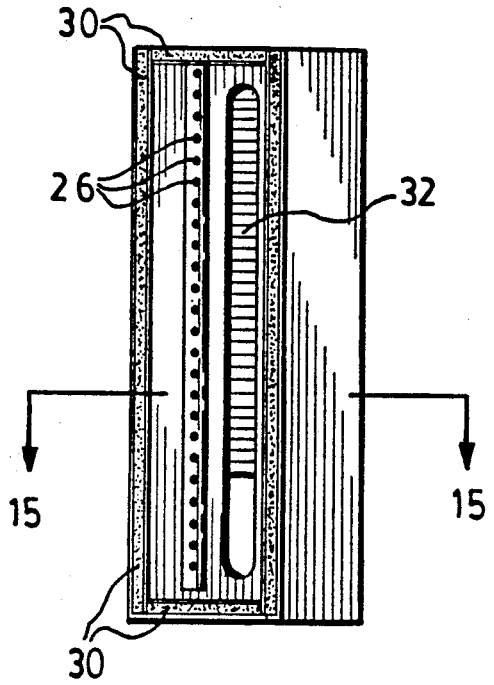
FIG. 14 is an elevation view of the side of the center grind embodiment which faces the tire.
Figure 15:
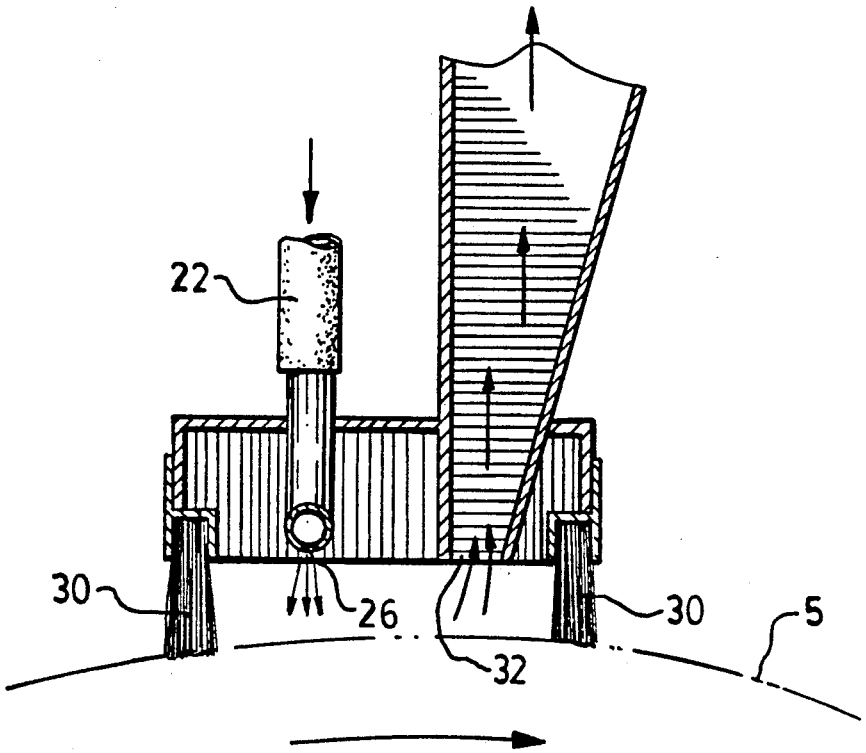
FIG. 15 is a plan view of the center grind embodiment, in section.

The other reason for the head to widen out, of course, is to provide sufficient width for the full face of the tire to be covered, as seen in FIG. 7.

Shoulder Grind Version

As discussed above, some machines work on a face grind, whereas others are so-called shoulder grind machines. In an alternative embodiment directed towards the shoulder grind machines, as shown in FIGS. 8-12, two separate collection heads 16 are mounted, each on its own arm 20, one wrapping around each shoulder, each moveable via separate actuators 18. The collection volume is again defined between the collection head and the tire by the brushes 30. In this case, one of the brushes wraps around the side wall of the tire.

Center Grind Version

In some versions of the grinding machines, the grinding wheel moves in and out on a line with the center of the tire, rather than swinging into position. In an alternative embodiment for such machines, as shown in FIGS. 13-17, the collection head is mounted in a semi-fixed fashion on the support arm. It is adjustable with respect to the support arm by virtue of a clamping bracket 40 which is itself adjustably mounted on a plate 42, adjustable via a handscrew 44, and its angle may also be changed if necessary by virtue of a slotted hole 46 on the plate 48, which is pivotally connected to the plate 42, pivoting about pivot point 49.

The collection head in this embodiment is not pivotable with respect to the arm 20.

Sidewall Version

Figure 18:
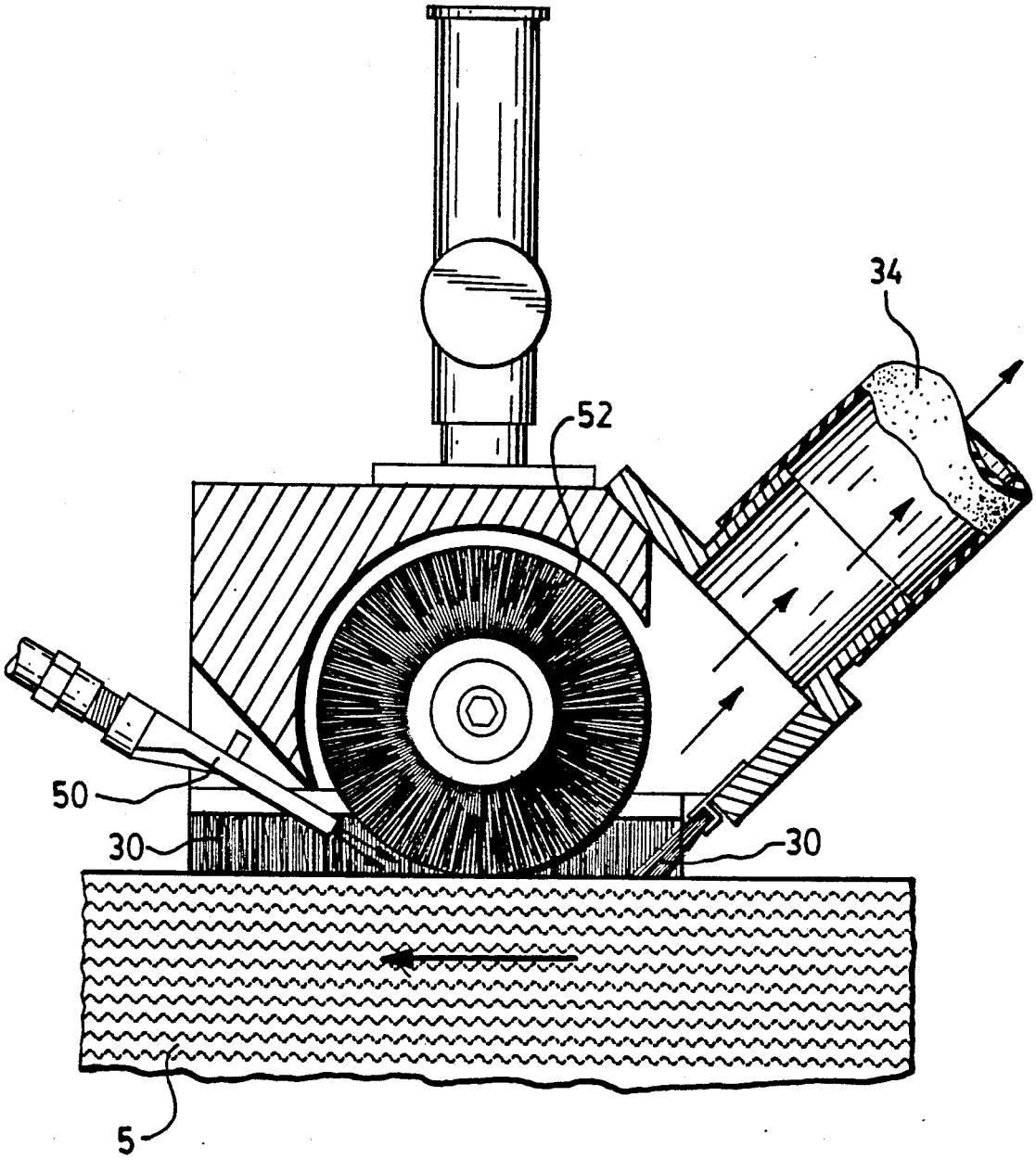
FIG. 18 is an elevation view of the "sidewall" embodiment of the invention.

In the version intended to remove dust from the sidewalls of a tire, illustrated in FIGS. 18-20, an air jet 50 is directed towards the sidewall, and a rotary brush 52 aids in removing the dust from the sidewall area, for collection via a vacuum aspiration arm 34. Brushes 30 define a collection volume as in the above embodiments.

It will be appreciated that the above description relates to preferred embodiments only, by way of example. Other embodiments will be obvious to those who are knowledgeable in the field of the invention, and such obvious variations are considered to be within the scope of the invention as defined by the claims, whether or not expressly referred to above.

What is claimed as the invention is:

1. Tire dust removal apparatus for use in conjunction with a tire grinding machine, where said tire grinding machine includes a grinding wheel on a grinding arm, moveable into and out of contact with a tire mounted in said machine for rotation, said tire dust removal apparatus comprising:

an arm mounted at one end of thereof to said tire grinding machine;

a collection head mounted on the other end of said arm, said collection head having a plurality of brushes projecting therefrom towards said tire, said brushes together with said tire defining a substantially enclosed collection volume adjacent the grinding location;

suction means communicating with said collection volume to draw air and dust therefrom; and means for moving said arm to bring said brushes into and out of contact with the surface of said tire;

where said collection head is pivotally mounted on said arm, for pivoting about an axis parallel to the face of said tire.

2. Tire dust removal apparatus as recited in claim 1, further comprising spacer wheels mounted on the collection head to ride against the surface of the tire to maintain said collection head in the correct position.

3. Tire dust removal apparatus for use in conjunction with a tire grinding machine, where said tire grinding machine includes a grinding wheel on a grinding arm, moveable into and out of contact with a tire mounted in said machine for rotation, said tire dust removal apparatus comprising:

an arm mounted at one end of thereof to said tire grinding machine;

a collection head mounted on the other end of said arm, said collection head having a plurality of brushes projecting therefrom towards said tire, said brushes together with said tire defining a substantially enclosed collection volume adjacent the grinding location;

suction means communicating with said collection volume to draw air and dust therefrom; and means for moving said arm to bring said brushes into and out of contact with the surface of said tire;

further comprising spacer wheels mounted on the collection head to ride against the surface of the tire to maintain said collection head in the correct position.

4. Tire dust removal apparatus for use in conjunction with a tire grinding machine, where said tire grinding machine includes a grinding wheel on a grinding arm, moveable into and out of contact with a tire mounted in said machine for rotation, said tire dust removal apparatus comprising:

an arm mounted at one end of thereof to said tire grinding machine;

a collection head mounted on the other end of said arm, said collection head having a plurality of brushes projecting therefrom towards said tire, said brushes together with said tire defining a substantially enclosed collection volume adjacent the grinding location;

suction means communicating with said collection volume to draw air and dust therefrom; and means for moving said arm to bring said brushes into and out of contact with the surface of said tire;

where said suction means communicates with said collection volume via said arm, said arm being hollow for that purpose, where said collection head is pivotally mounted on said arm, for pivoting about an axis parallel to the face of said tire, and further comprising spacer wheels mounted on the collection head to ride against the surface of the tire to maintain said collection head in the correct position.

* * * * *